US008905875B1

(12) United States Patent
Long et al.

(10) Patent No.: US 8,905,875 B1
(45) Date of Patent: Dec. 9, 2014

(54) ARROW SYSTEM

(71) Applicants: Todd M. Long, Nebo, KY (US); Steven Brady, Hamberg, PA (US)

(72) Inventors: Todd M. Long, Nebo, KY (US); Steven Brady, Hamberg, PA (US)

( * ) Notice: Subject to any disclaimer, the term of this patent is extended or adjusted under 35 U.S.C. 154(b) by 0 days.

(21) Appl. No.: 13/932,526

(22) Filed: Jul. 1, 2013

Related U.S. Application Data

(63) Continuation-in-part of application No. 13/233,464, filed on Sep. 15, 2011, now Pat. No. 8,500,579.

(51) Int. Cl.

| | |
|---|---|
| ***F42B 6/06*** | (2006.01) |
| ***F42B 6/04*** | (2006.01) |
| ***F42B 6/08*** | (2006.01) |
| ***F41B 5/12*** | (2006.01) |

(52) U.S. Cl.
CPC ... *F42B 6/04* (2013.01); *F42B 6/08* (2013.01); *F41B 5/12* (2013.01); *F42B 6/06* (2013.01)
USPC ..... 473/586

(58) Field of Classification Search
CPC ..... F42B 6/04; F42B 6/06
USPC ..... 473/578, 585, 586
See application file for complete search history.

(56) References Cited

U.S. PATENT DOCUMENTS

| | | | |
|---|---|---|---|
| D185,249 | S | 5/1959 | Wampfler |
| 4,266,782 | A | 5/1981 | Patterson |
| 4,277,069 | A | 7/1981 | Rouse |
| 4,380,340 | A | 4/1983 | Simo |
| 4,534,568 | A | 8/1985 | Tone |
| 5,119,797 | A | 6/1992 | Anderson |
| 6,186,913 | B1 | 2/2001 | Thomas |
| 6,238,310 | B1 | 5/2001 | Morrison |
| 6,669,585 | B2 | 12/2003 | Sutherland et al. |
| 6,695,727 | B1 | 2/2004 | Kuhn |
| 6,705,808 | B2 | 3/2004 | Kane |

*Primary Examiner* — John Ricci

(57) ABSTRACT

An arrow system for reducing a kill time of a prey features an arrow shaft and an arrowhead. An arrowhead first end features a terminating point for piercing and an arrowhead second end features an arrowhead threaded rod for attaching to a shaft first end. The system features a tail component having a tail second end with a nock for interfacing with a bow string. A tail first end features a tail threaded rod for attaching to a shaft second end. A plurality of fletchings, each having a sharp edge, is located on an outer periphery of the tail component. Each fletching features a centrally located aperture. Each fletching outer periphery features a shape of a scalene triangle. Each fletching aperture features a shape of a similar triangle with respect to the scalene-triangle-shaped fletching outer periphery.

13 Claims, 3 Drawing Sheets

ARROW SYSTEM

CROSS REFERENCE

This application claims priority to U.S. patent application Ser. No. 13/233,464, filed Sep. 15, 2011, the specification of which is incorporated herein in its entirety by reference.

FIELD OF THE INVENTION

The present invention relates to archery, or more specifically, arrows with fletching.

BACKGROUND OF THE INVENTION

Archery has been known virtually since the dawn of human history. Many improvements have been made to the components used in archery throughout the ages, even though tenets such as the arrowhead, shaft, and fletchings remain recognizable. The present invention features an arrow system for reducing a kill time of a prey.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an arrow system for reducing a kill time of a prey. In some embodiments, the system comprises an arrow shaft. In some embodiments, the system comprises an arrowhead. In some embodiments, an arrowhead first end comprises a terminating point for piercing and an arrowhead second end comprises an arrowhead threaded rod for attaching to a first threaded female connection located on a shaft first end.

In some embodiments, the system comprises a tail component. In some embodiments, a tail second end comprises a nock located thereon for interfacing with a bow string. In some embodiments, a tail first end comprises a tail threaded rod for attaching to the second threaded female connection located on the shaft second end. In some embodiments, a plurality of fletchings is located on an outer periphery of the tail component thereon. In some embodiments, each fletching comprises an aperture centrally located therein. In some embodiments, each fletching outer periphery comprises a shape of a scalene triangle. In some embodiments, each fletching aperture comprises a shape of a similar triangle with respect to the scalene triangle shaped fletching outer periphery.

DESCRIPTION OF PREFERRED EMBODIMENTS

Figure 1:
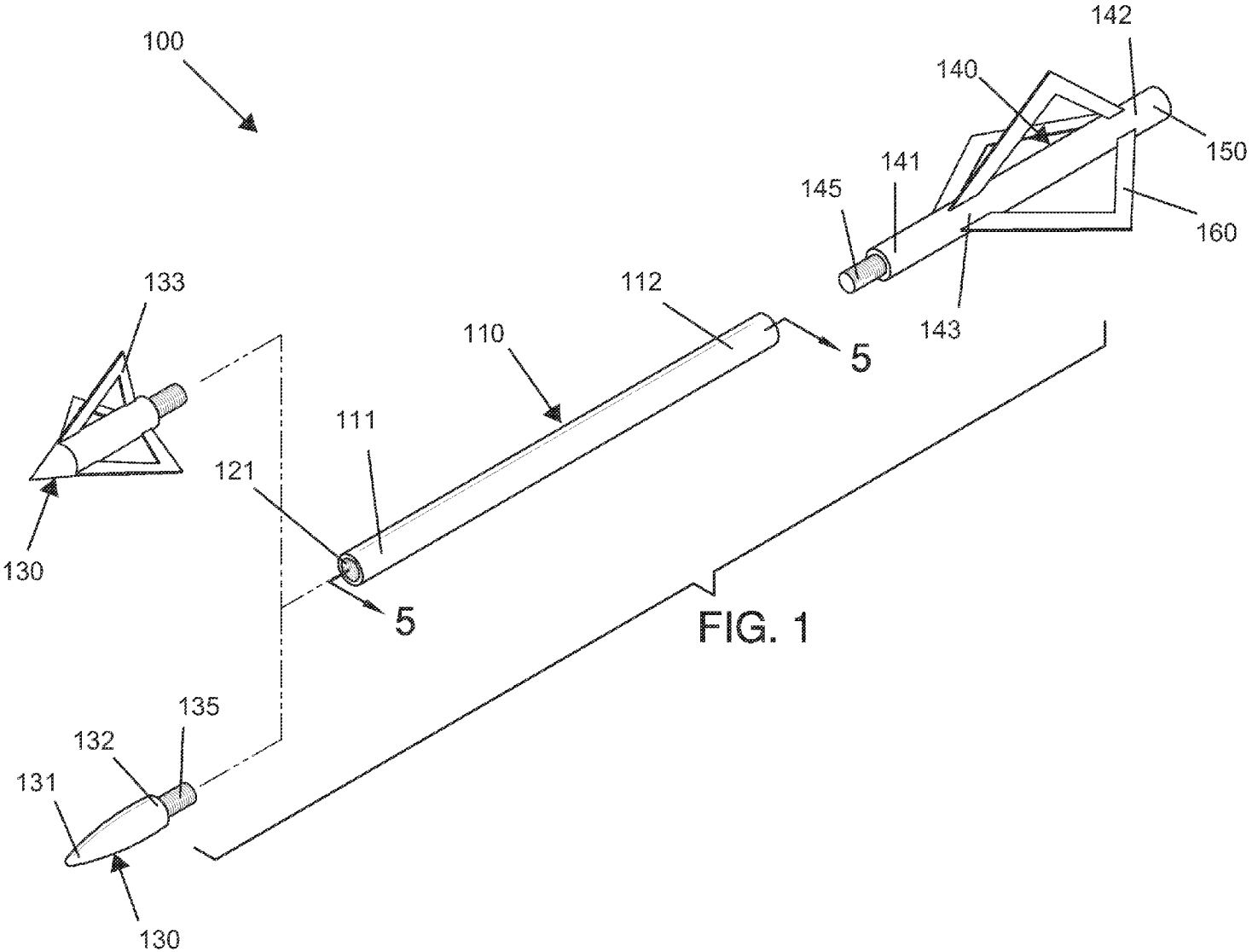
FIG. 1 shows a perspective view of the present invention.
Figure 2:
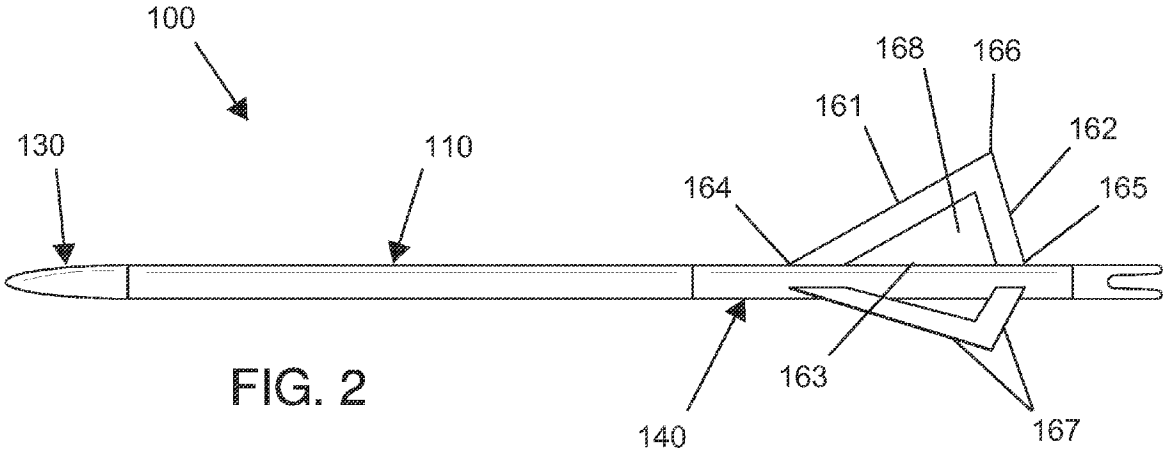
FIG. 2 shows a side view of the present invention.
Figure 4:
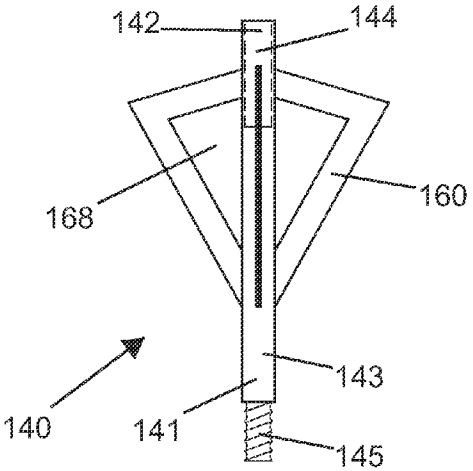
FIG. 4 shows a top view of the tail component of the present invention.
Figure 3:
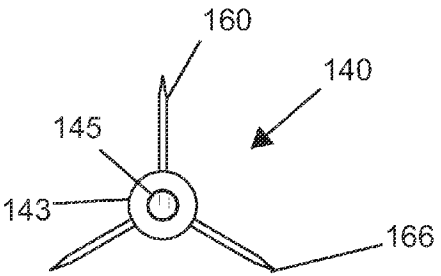
FIG. 3 shows a front view of the tail component of the present invention.
Figure 5:
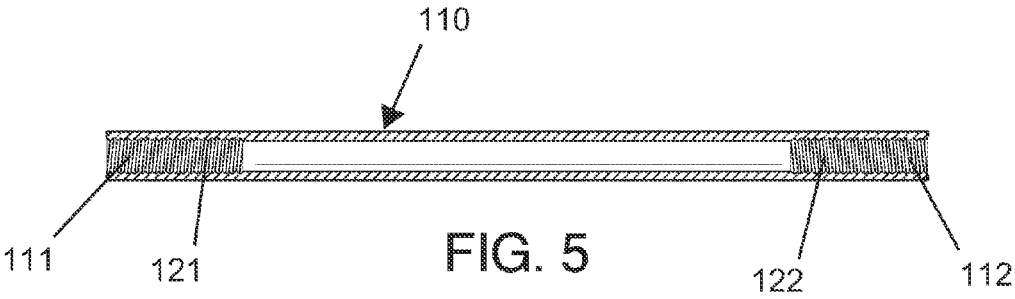
FIG. 5 shows a cross-sectional view of the arrow shaft of the present invention.
Figure 6:
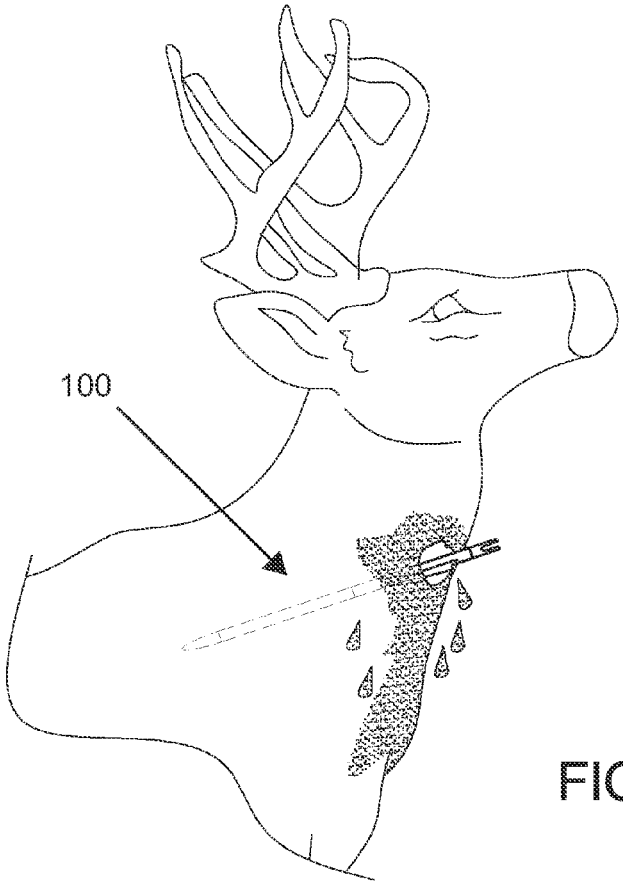
FIG. 6 shows a perspective view of the present invention in use.

Following is a list of elements corresponding to a particular element referred to herein:

100 Arrow system
110 Arrow shaft
111 Shaft first end
112 Shaft second end
121 First threaded female connection
122 Second threaded female connection
130 Arrowhead
131 Arrowhead first end
132 Arrowhead second end
133 Arrowhead blade
135 Arrowhead threaded rod
140 Tail component
141 Tail first end
142 Tail second end
143 Tail component outer periphery
144 Third threaded female connection
145 Tail threaded rod
150 Nock
160 Fletching
161 Fletching first side
162 Fetching second side
163 Fletching third side
164 Fletching first end
165 Fletching second end
166 Fletching high point
167 Fletching edge
168 Fletching aperture Referring now to FIG. 1-6, the present invention features an arrow system (100) for reducing the kill time of a prey. In some embodiments, the system (100) weights between about 420 and about 620 grains. In some embodiments, the system (100) weighs about 532 grains. In some embodiments, one grain is $1/7000$ lb. In some embodiments, 1 gram is 15.432 grains.

In some embodiments, the system (100) comprises a hollow arrow shaft (110) having a shaft first end (111) and a shaft second end (112). In some embodiments, a first threaded female connection (121) is located in the shaft first end (111). In some embodiments, a second threaded female connection (122) is located in the shaft second end (112).

In some embodiments, the arrow shaft (110) is about half the length of a normal arrow shaft. In some embodiments, a normal arrow shaft is about 12 inches long. In some embodiments, a normal arrow shaft is about 18 inches long. In some embodiments, the arrow shaft (110) is about 6 inches long. In some embodiments, the arrow shaft (110) is about 9 inches long. In some embodiments, an arrow shaft length is critical to the effectiveness of the invention as it is desirable to have a shortened arrow shaft length to allow the fletching to have a greater opportunity to contact the wound of the prey after entry of the arrowhead (130).

In some embodiments, the arrow shaft (110) has an inner diameter of 0.188 inches. In some embodiments, the arrow shaft (110) has an outer diameter of 0.375 inches. In some embodiments, the arrow shaft (110) is constructed from aluminum. In some embodiments, the arrow shaft (110) weighs about 246 grains.

In some embodiments, the system (100) comprises an arrowhead (130) having an arrowhead first end (131) and an arrowhead second end (132). In some embodiments, the arrowhead first end (131) comprises a terminating point for piercing the prey. In some embodiments, the arrowhead second end (132) comprises an arrowhead threaded rod (135) extending therefrom for attaching to the first threaded female connection (121) located on the shaft first end (111). In some embodiments, the arrowhead (130) weights between 100 and 125 grains. In some embodiments, the arrowhead (130) weighs 100 grains.

In some embodiments, the arrowhead (130) features large cutting blades that create a large wound on the prey for improved blood flow. In some embodiments, the arrowhead (130) features cutting blades on both ends and is constructed from a metal such as steel. In some embodiments, the arrowhead (130) is interchangeable for a variety of arrowheads, for example, Bodkin Points, Blunts, Judo Points, Expandable Broadhead Points, Three Blade Points, Broadhead Points, Target Points, Safety Arrows, and Field Points.

In some embodiments, the system (100) comprises a tail component (140) having a tail first end (141) and a tail second end (142). In some embodiments, the tail second end (142) comprises a nock (150) located thereon for interfacing with a bow string. In some embodiments, the nock (150) is a flat nock. In some embodiments, the nock (150) is a moon nock. In some embodiments, the nock (150) is about 1.3145 inches long. In some embodiments, about 0.683 inches of the nock (150) is counter sunk into the tail second end (142) for securing the nock (150) to the tail component (140). In some embodiments, about 0.639 inches of the nock (150) is visible from a side view. In some embodiments, the nock (150) weighs about 12 grains.

In some embodiments, the tail first end (141) comprises a tail threaded rod (145) extending therefrom for attaching to the second threaded female connection (122) located on the shaft second end (112). In some embodiments, the tail second end comprises a third threaded female connection (144) for threadably attaching the nock (150). In some embodiments, the tail component (140) is about 4 inches long and includes the length of the nock (150) that is counter sunk into the tail second end (142). In some embodiments, the tail component (140) weighs about 174 grains.

In some embodiments, a plurality of fletchings (160) is located on a tail component outer periphery (143) thereon. In some embodiments, each fletching (160) comprises a shape of a scalene triangle. In some embodiments, each fletching (160) comprises a fletching first side (161), a fletching second side (162), and a fletching third side (163). In some embodiments, the fletching first side (161) and the fletching second side (162) comprises sharp fletching edges (167) located thereon. In some embodiments, the fletching (160) is razor thin and razor sharp. In some embodiments, the fletching third side (163) is located on the tail component outer periphery (143). In some embodiments, the fletching third side (163) is interrupted and does not connect the fletching first end (164) and the fletching second end (165).

In some embodiments, each fletching (160) comprises a fletching first end (164) and a fletching second end (165). In some embodiments, the fletching first end (164) is located at an intersection of the fletching first side (161) and the fletching third side (163). In some embodiments, the fletching second end (165) is located at an intersection of the fletching second side (162) and the fletching third side (163).

In some embodiments, the fletching first end (164) originates at the tail component outer periphery (143) close to the tail first end (141). In some embodiments, tail component outer periphery (143) is the diameter of the tail component (140). In some embodiments, the fletching (160) rises from the fletching first end (164) to a fletching high point (166) at an intersection of the fletching first side (161) and the fletching second side (162) then tapers to the fletching second end (165) terminating at the tail component outer periphery (143) close to the tail second end (142).

In some embodiments, each fletching (160) comprises a fletching aperture (168) located therein. In some embodiments, each fletching aperture (168) comprises a shape of a similar triangle with respect to the shape of the fletching (160). In some embodiments, each fletching aperture (168) comprises a shape of a scalene triangle. In some embodiments, a definition of a similar triangle is as follows: "not differing in shape but only in size or position (as in) similar triangles" as found at: http://www.merriam-webster.com/dictionary/similar.

In some embodiments, the fletching (160) is constructed from plastic or a metal such as aluminum or steel. In some embodiments, the fletching (160) is about 2 inches long. In some embodiments, the fletching (160) is about 3 inches long. In some embodiments, the fletching (160) is about ½ inches high. In some embodiments, the fletching (160) is about 1 inches high. In some embodiments, the fletching (160) is about 2 inches high. In some embodiments, the fletching (160) is about 3 inches high.

In some embodiments, the arrowhead (130) is a broadhead arrowhead comprising a plurality of sharp arrowhead blades (133) located on an arrowhead outer periphery thereon.

In some embodiments, each arrowhead blade (133) comprises an arrowhead aperture located therein.

In some embodiments, the arrowhead comprises two sharp arrowhead blades (133). In some embodiments, the arrowhead comprises three sharp arrowhead blades (133). In some embodiments, the arrowhead comprises four sharp arrowhead blades (133).

In some embodiments, the arrow shaft (110) is half a length of a traditional arrow shaft. In some embodiments, the arrow shaft (110) is between about 6 and about 8 inches in length. In some embodiments, the arrow shaft (110) is between about 8 and about 12 inches in length. In some embodiments, the arrow shaft (110) is between about 12 and about 18 inches in length.

In some embodiments, the arrowhead (130) is interchangeable. In some embodiments, the tail component (140) is interchangeable.

In some embodiments, for effectiveness and balance, a ratio of the length of the arrow shaft (110) to the tail component (140) is 3:2. In some embodiments, for effectiveness and balance, a ratio of the length of the arrow shaft (110) to the tail component (140) is about 2:1.

In some embodiments, the system (100) comprises a bow. In some embodiments, the system (100) comprises a crossbow. In some embodiments, the system (100) is specifically designed to be effective with a crossbow.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An arrow system (100) for reducing the kill time of a prey, wherein the system (100) comprises:

(a) a hollow arrow shaft (110) having a shaft first end (111) and a shaft second end (112), wherein a first threaded female connection (121) is disposed in the shaft first end (111), wherein a second threaded female connection (122) is disposed in the shaft second end (112);

(b) an arrowhead (130) having an arrowhead first end (131) and an arrowhead second end (132), wherein the arrowhead first end (131) comprises a terminating point for piercing the prey, wherein the arrowhead second end (132) comprises an arrowhead threaded rod (135) extending therefrom for attaching to the first threaded female connection (121) disposed on the shaft first end (111);

(c) a tail component (140) having a tail first end (141) and a tail second end (142), wherein the tail second end (142) comprises a nock (150) threadably disposed thereon for interfacing with a bow string, wherein the tail first end (141) comprises a tail threaded rod (145) extending therefrom for attaching to the second threaded female connection (122) disposed on the shaft second end (112), wherein a plurality of fletchings (160) is disposed on a tail component outer periphery (143) thereon, wherein each fletching (160) comprises a shape of a scalene triangle, wherein each fletching (160) comprises a fletching first side (161), a fletching second side (162), and a fletching third side (163), wherein the fletching first side (161) and the fletching second side (162) comprise sharp fletching edges (167) disposed thereon, wherein the fletching third side (163) is disposed on the tail component outer periphery (143), wherein each fletching (160) comprises a fletching first end (164) and a fletching second end (165), wherein the fletching first end (164) is disposed at an intersection of the fletching first side (161) and the fletching third side (163), wherein the fletching second end (165) is disposed at an intersection of the fletching second side (162) and the fletching third side (163), wherein the fletching first end (164) originates at the tail component outer periphery (143) proximal to the tail first end (141), wherein the fletching (160) rises from the fletching first end (164) to a fletching high point (166) at an intersection of the fletching first side (161) and the fletching second side (162) then tapers to the fletching second end (165) terminating at the tail component outer periphery (143) proximal to the tail second end (142), wherein each fletching (160) comprises a fletching aperture (168) disposed therein, wherein each fletching aperture (168) comprises a shape of a similar triangle with respect to the shape of the fletching (160).

2. The system (100) of claim 1, wherein the arrowhead (130) is a broadhead arrowhead comprising a plurality of sharp arrowhead blades (133) disposed on an arrowhead outer periphery thereon.

3. The system (100) of claim 2, wherein each arrowhead blade (133) comprises an arrowhead aperture disposed therein.

4. The system (100) of claim 2, comprising two sharp arrowhead blades (133).

5. The system (100) of claim 2, comprising three sharp arrowhead blades (133).

6. The system (100) of claim 2, comprising four sharp arrowhead blades (133).

7. The system (100) of claim 1, wherein the arrow shaft (110) is half a length of a traditional arrow shaft, wherein the arrow shaft (110) is between 6 and 8 inches in length.

8. The system (100) of claim 1, wherein the arrow shaft (110) is half a length of a traditional arrow shaft, wherein the arrow shaft (110) is between 8 and 12 inches in length.

9. The system (100) of claim 1, wherein the arrow shaft (110) is half a length of a traditional arrow shaft, wherein the arrow shaft (110) is between 12 and 18 inches in length.

10. The system (100) of claim 1, wherein the arrowhead (130) is interchangeable.

11. The system (100) of claim 1, wherein the tail component (140) is interchangeable.

12. The system (100) of claim 1, comprising a bow.

13. The system (100) of claim 1, comprising a crossbow.

* * * * *